US008201272B2

(12) United States Patent
Winningham

(10) Patent No.: US 8,201,272 B2
(45) Date of Patent: Jun. 19, 2012

(54) PROTECTIVE GLOVE HAVING SEGMENTED WRIST GUARD

(75) Inventor: Matthew M. Winningham, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 378 days.

(21) Appl. No.: 12/538,956

(22) Filed: Aug. 11, 2009

(65) Prior Publication Data

US 2009/0300821 A1 Dec. 10, 2009

Related U.S. Application Data

(63) Continuation-in-part of application No. 12/237,118, filed on Sep. 24, 2008, now Pat. No. 8,141,175, which is a continuation-in-part of application No. 12/051,230, filed on Mar. 19, 2008, now Pat. No. 7,836,521, which is a continuation-in-part of application No. 12/051,292, filed on Mar. 19, 2008, now Pat. No. 7,841,023, which is a continuation-in-part of application No. 12/051,201, filed on Mar. 19, 2008, now Pat. No. 7,861,321, which is a continuation-in-part of application No. 29/336,180, filed on Apr. 29, 2009, now Pat. No. Des. 626,696.

(60) Provisional application No. 60/975,315, filed on Sep. 26, 2007, provisional application No. 60/895,502, filed on Mar. 19, 2007, provisional application No. 60/895,502, filed on Mar. 19, 2007, provisional application No. 60/895,502, filed on Mar. 19, 2007.

(51) Int. Cl.
*A41D 19/00* (2006.01)

(52) U.S. Cl. ..... 2/161.1; 2/162

(58) Field of Classification Search ..... 2/16, 20, 2/161.1, 161.6, 162

See application file for complete search history.

(56) References Cited

U.S. PATENT DOCUMENTS

| | | | |
|---|---|---|---|
| 1,010,199 | A | 11/1911 | Stedman |
| 1,841,193 | A | 1/1932 | Lidston |
| 1,934,332 | A | 11/1933 | Skinner |
| 2,293,347 | A | 8/1942 | Lindfelt |
| 2,708,753 | A | 5/1955 | Kennedy |
| 2,831,196 | A | 4/1958 | Scheiber |

(Continued)

FOREIGN PATENT DOCUMENTS

DE 2612307 9/1977

(Continued)

OTHER PUBLICATIONS

1997 DR Catalog, p. 15.

(Continued)

*Primary Examiner* — Katherine Moran

(74) *Attorney, Agent, or Firm* — Warner Norcross & Judd LLP

(57) ABSTRACT

A protective sports glove including a contoured wrist cuff that substantially shields a gap defined between adjacent portions of the protective sports glove, such as hand and cuff portions. The contoured wrist cuff and/or the cuff portion can include multiple segments that enable the wrist cuff to flex with a wearer's wrist. The contoured wrist cuff can include a leading edge that contours forwardly adjacent a thumb portion of the contoured wrist cuff and rearwardly across a portion of the radial side of a wearer's hand when the glove is on the wearer's hand. This can allow protection of the wearer's wrist in flexion without also impairing movement of the wearer's wrist.

23 Claims, 7 Drawing Sheets

U.S. PATENT DOCUMENTS

| | | | | |
|---|---|---|---|---|
| 3,387,306 | A | | 6/1968 | Korey |
| 3,605,117 | A | | 9/1971 | Latina |
| 3,725,957 | A | | 4/1973 | Shotmeyer |
| 4,027,339 | A | | 6/1977 | Brucker |
| 4,137,572 | A | | 2/1979 | Jansson et al. |
| 4,190,902 | A | | 3/1980 | Rhee |
| D257,909 | S | | 1/1981 | Brine |
| 4,411,024 | A | | 10/1983 | Hayes |
| 4,484,359 | A | | 11/1984 | Tirinen |
| 4,497,073 | A | | 2/1985 | Deutsch |
| 4,677,698 | A | | 7/1987 | Angas |
| 4,815,147 | A | | 3/1989 | Gazzano et al. |
| 4,930,162 | A | | 6/1990 | Cote |
| 4,967,418 | A | | 11/1990 | Marcotte |
| 4,977,073 | A | | 12/1990 | Ishige et al. |
| 5,237,703 | A | | 8/1993 | Brine et al. |
| 5,329,639 | A | | 7/1994 | Aoki |
| 5,390,372 | A | | 2/1995 | Hashimoto et al. |
| 5,488,739 | A | | 2/1996 | Cardinal |
| 5,511,243 | A | | 4/1996 | Hall et al. |
| 5,530,967 | A | | 7/1996 | Cielo |
| 5,745,916 | A | | 5/1998 | Linner |
| 5,781,929 | A | | 7/1998 | Shikatani |
| 5,787,506 | A | | 8/1998 | Wilder et al. |
| 5,946,720 | A | | 9/1999 | Sauriol |
| 5,983,396 | A | * | 11/1999 | Morrow et al. ..... 2/161.1 |
| 6,085,354 | A | | 7/2000 | Wilder et al. |
| 6,122,769 | A | | 9/2000 | Wilder et al. |
| 6,233,744 | B1 | | 5/2001 | McDuff |
| 6,550,069 | B1 | | 4/2003 | Morrow |
| 6,643,844 | B2 | | 11/2003 | Morrow et al. |
| 7,114,193 | B2 | | 10/2006 | Winningham |
| 7,117,540 | B2 | | 10/2006 | Morrow |
| 2005/0114984 | A1 | | 6/2005 | Morrow et al. |
| 2006/0260022 | A1 | * | 11/2006 | Vaughn ..... 2/163 |

FOREIGN PATENT DOCUMENTS

| | | |
|---|---|---|
| DE | 2842720 | 4/1980 |
| DE | 2843448 | 4/1980 |
| DE | 3135756 | 4/1983 |
| GB | 2148094 A | 5/1985 |
| WO | 99/43225 | 9/1999 |

OTHER PUBLICATIONS

1996 JOFA Catalog, page number unknown.
American Society for Surgery of the Hand, Hand Anatomy Diagrams, 2002.
2000 STX Catalog, Pro 22 Glove.
Sentry Player Gloves (prior art).
2002 Brine X-Factor Gel Lacrosse Glove.
1994-1995 STX Lacrosse Equipment Catalog, p. 8.
1987 Brine Lacrosse Catalog, pp. 12-13.
1983 Bacharach Rasin Lacrosse Catalog, p. 2.
1981 STX Catalog, page unknown.
1980 STX Lacrosse Catalog, page unknown.
1975 STX Lacrosse Catalog, p. 11.
Canadian Office Action for Canadian Application 2,639,950 dated Jun. 8, 2010.

* cited by examiner

PROTECTIVE GLOVE HAVING SEGMENTED WRIST GUARD

CROSS-REFERENCE TO RELATED APPLICATIONS

This application is a continuation-in-part of U.S. Application Ser. No. 12/237,118, filed on Sep. 24, 2008, which claims priority benefit to U.S. Provisional Application Ser. No. 60/975,315, filed on Sep. 26, 2007 now U.S. Pat. No. 8,141,175, all of which are hereby incorporated by reference. The present application also is a continuation-in-part of U.S. application Ser. No. 12/051,230, filed on Mar. 19, 2008, now U.S. Pat. 7,836,521, which claims priority benefit to U.S. Provisional Application 60/895,502, filed on Mar. 19, 2007, all of which are hereby incorporated by reference. The present application also is a continuation-in-part of U.S. Application Ser. No. 12/051,292, filed on Mar. 19, 2008, now U.S. Pat. 7,841,023, which claims priority benefit to U.S. Provisional Application Ser. No. 60/895,502, filed on Mar. 19, 2007, all of which are hereby incorporated by reference. The present application also is a continuation-in-part of U.S. Application Ser. No. 12/051,201, filed on Mar. 19, 2008, now U.S. Pat. 7,861,321, which claims priority benefit to U.S. Provisional Application Ser. No. 60/895,502, filed on Mar. 19, 2007, all of which are hereby incorporated by reference. This application also is a continuation-in-part of U.S. Application Ser. No. 29/336,180, filed on Apr. 29, 2009, now U.S. Pat. D626,696, which is hereby incorporated by reference.

BACKGROUND OF THE INVENTION

The present invention relates to a protective glove and, more particularly, to a protective sports glove having a wrist guard that provides enhanced flexibility and promotes ergonomic movement.

In many contact sports, such as lacrosse or hockey, sticks are elements of the game. A player's hands, wrists, and lower arms are especially vulnerable to injury when being checked by another player's stick. For this reason, players typically wear padded gloves to protect their hands, wrists and lower arms during play.

Typical gloves for such contact sports generally include a hand portion joined with finger portions and a thumb portion. The hand portion, finger portions, and thumb portion each have a respective palm portion and a dorsal portion which is usually covered with multiple protective pads. The protective pads typically protect the dorsal side of the hand from forceful impacts. The gloves also can include a protective cuff that is elastically joined with a lower edge of the hand portion. This usually extends up the wearer's wrist and forearm. The protective pads that protect the dorsal side of the hand usually are formed in such a way so as to allow the wearer to grasp a game stick, yet still provide protection against impact.

Protective sports gloves also can include an additional protective element that is intended to further protect the wrist from impacting blows administered directly to the wrist. These pads, called wrist guards or wrist cuffs, are loosely strapped between the hand portion and the cuff portion. In use, a wearer usually flexes their wrist, which can separate the hand and cuff portions. The wrist guard covers a gap between these portions, protecting the wrist of the wearer.

Many wrist guards are substantially rectangular in configuration and sharply sweep across the back, or dorsal side of the hand from left to right. While this rectangular configuration thoroughly covers the vulnerable gap over a wearer's wrist, it can substantially impair movement and flexibility of the wrist, particularly movements required to manipulate a stick in the game of lacrosse and hockey. Other conventional gloves include non-rectangular wrist guards that facilitate some flexibility, but still may encumber some wrist movement. For example, U.S. Pat. No. 5,983,396 to Morrow discloses an adjustably positionable wrist guard having a rounded forearm facing portion and a centrally located bulge on the finger facing, forward side of the guard. While the forward facing bulge can add protection, in some cases, it can also impair extension of the wrist.

SUMMARY OF THE INVENTION

The present invention provides a protective glove that yields increased protection to the wrist of a wearer without substantially impairing the wearer's wrist movements, including, but not limited to, radial and ulnar deviation, wrist extension and flexion, and combinations of these movements. The protective glove can include a hand portion and a cuff portion having a junction therebetween. A wrist cuff, also referred to as a wrist guard, can cover at least a portion of a junction, yet not impair radial deviation, and/or extension of the wearer's wrist, and/or any other wrist movement, due to ergonomic contours of the wrist cuff.

In one embodiment, the protective glove can include finger and thumb portions. The wrist cuff can define a leading edge that generally faces forward, toward the finger and thumb portions. The leading edge can include a contour that does not impair wrist movement. For example, the leading edge can contour rearwardly across a dorsal side of a wearer's hand, contour forwardly across a portion of the thumb portion, and/or contour rearwardly across at least a portion of the radial side of the wearer's hand.

In another embodiment, the protective glove can include a wrist cuff defining a leading edge generally facing forward, toward the finger and thumb portions, and extending across the dorsal side of a wearer's hand. The leading edge can define a curvilinear portion where the leading edge transitions from a dorsal side to a radial side of the wearer's hand, and can extend forwardly adjacent at least portion of the thumb portion of the protective glove.

In yet another embodiment, the wrist cuff can include a first end and a second end, and span across the hand portion, adjacent the wrist, and can be divided into multiple portions. Optionally, the leading edge can change its contour throughout these portions to promote enhanced wrist movement while the glove is on a wearer.

For example, the leading edge can extend through first, second, and third portions. The leading edge in the first portion can extend across a dorsal side of the wearer's hand and can be relatively straight, curved toward the finger and/or curved away from the finger portions of the glove. The leading edge in the second portion can extend forwardly in a straight or curved manner, toward the thumb portion adjacent the radial or palmar side of the wearer's hand. The leading edge in the third portion can extend rearwardly in a straight or curved manner, adjacent the radial or palmar sides of the wearer's hand. Having this configuration of a leading edge can conceal the junction between the cuff and the hand portion without impairing at least one of radial deviation and extension of the wearer's wrist, for example, when the wearer manipulates a game stick.

In a further embodiment, the wrist cuff can include a trailing edge, and can define a width between the leading edge and the trailing edge. The width can be uniform or can vary. The trailing edge can follow the trailing edge contours, or follow different contours as desired.

In yet another, further embodiment, the wrist cuff can include multiple segments flexibly and hingedly joined with one another. This construction can provide the wrist cuff with improved flexibility. Optionally, the ends of adjacent segments can include contours so that the ends cleanly overlap one another to provide a seamless appearing transition from segment to segment.

In an even further embodiment, where the protective glove includes a hand portion and a cuff portion, the cuff portion can include improved protection. For example, a cuff portion can include first and second cuff portions separated by a gap. At least one of the first and second cuff portions can include a cuff flap joined with the cuff portion via a flexible element. The cuff flap can extend outwardly into the gap to provide protection to a user's wrist located under the gap. The cuff flap and respective cuff portion can be contoured along their depth so that the components interfit with one another and cleanly conceal any gaps or spaces between them.

The present invention provides a simple and ergonomic protective wrist cuff. The contoured wrist cuff promotes wrist flexibility and movement of the hand it guards. With this construction, a wearer of the protective glove can easily and quickly move their hand and wrist without notable impairment or restriction by the glove.

These and other features and advantages of the present invention will become apparent from the following description of the invention, when viewed in accordance with the accompanying drawings and appended claims.

DETAILED DESCRIPTION OF THE CURRENT EMBODIMENT

Figure 1:
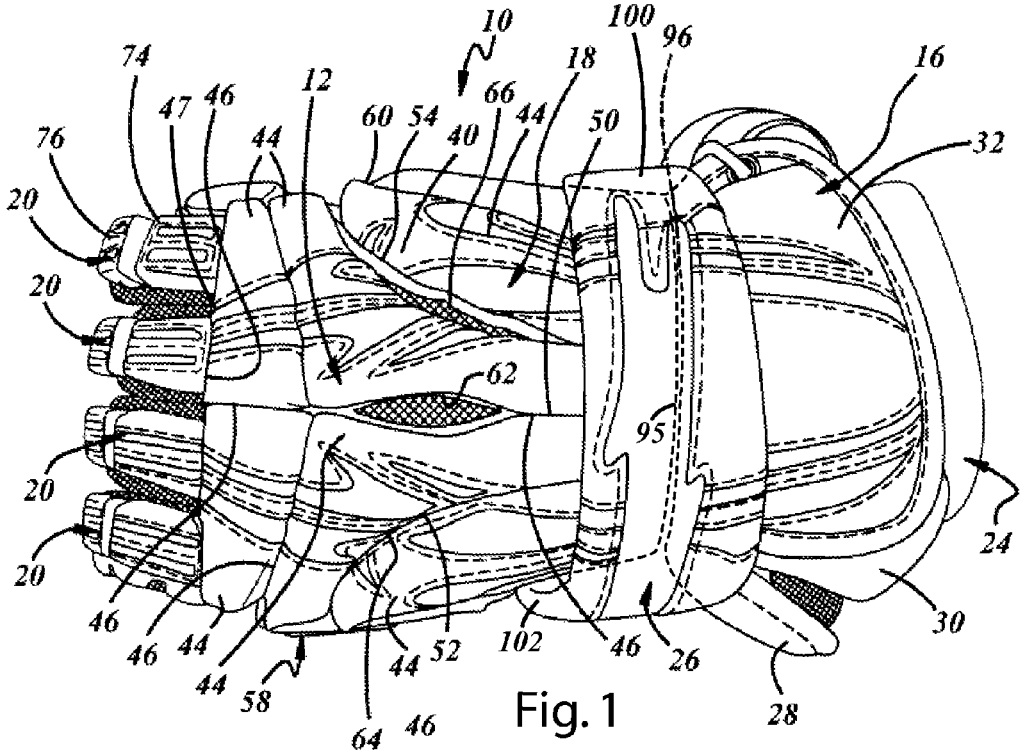
FIG. 1 is a top view of a current embodiment of the glove including a contoured wrist guard.

A protective sports glove in accordance with a current embodiment of the present invention is illustrated in FIGS. 1-6 and generally designated 10. While the drawing is illustrative of a right hand glove, the present invention can be embodied in a left hand glove, which is generally a mirrored version of the right hand glove. Additionally, the glove 10 shown is designed for use in the game of lacrosse; however, it can be used in a variety of other sports or activities, such as hockey, or any activity where a user may move their hand about their wrist, optionally in the process of manipulating a game stick or other grasped item.

Figure 6:
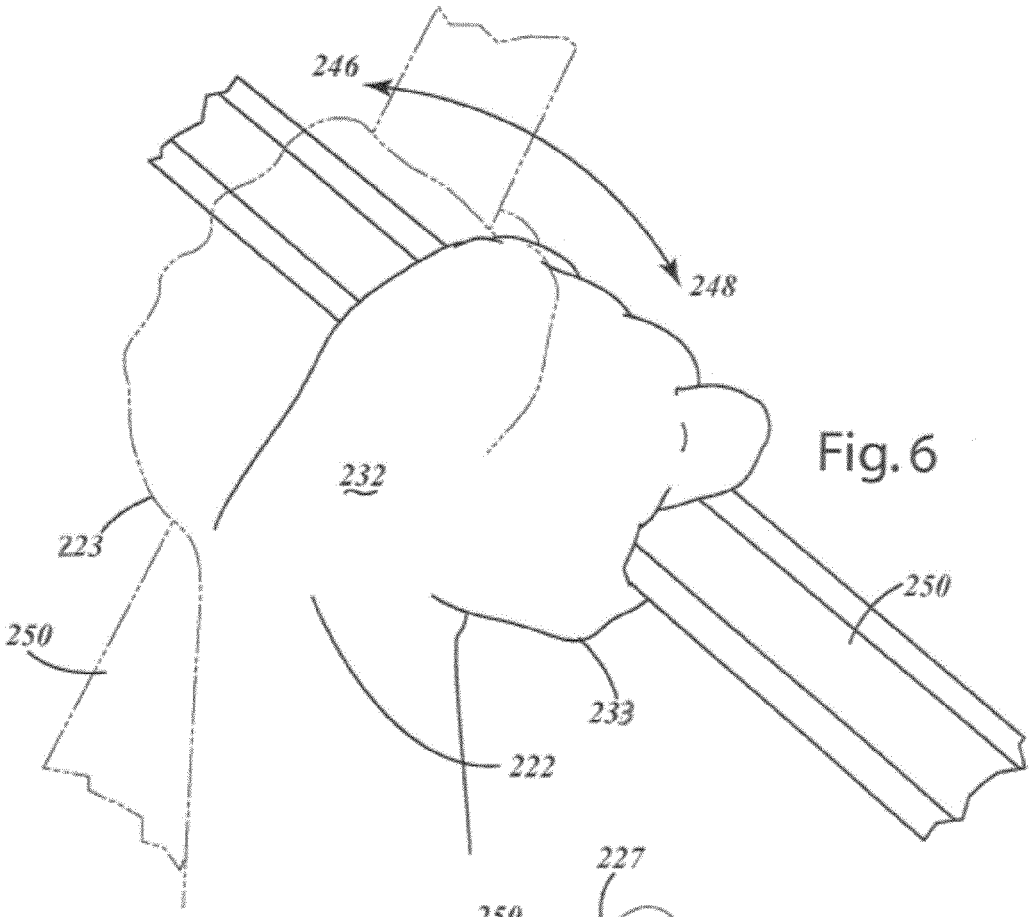
FIG. 6 is a top view illustration of movement of a wearer's hand.
Figure 7:
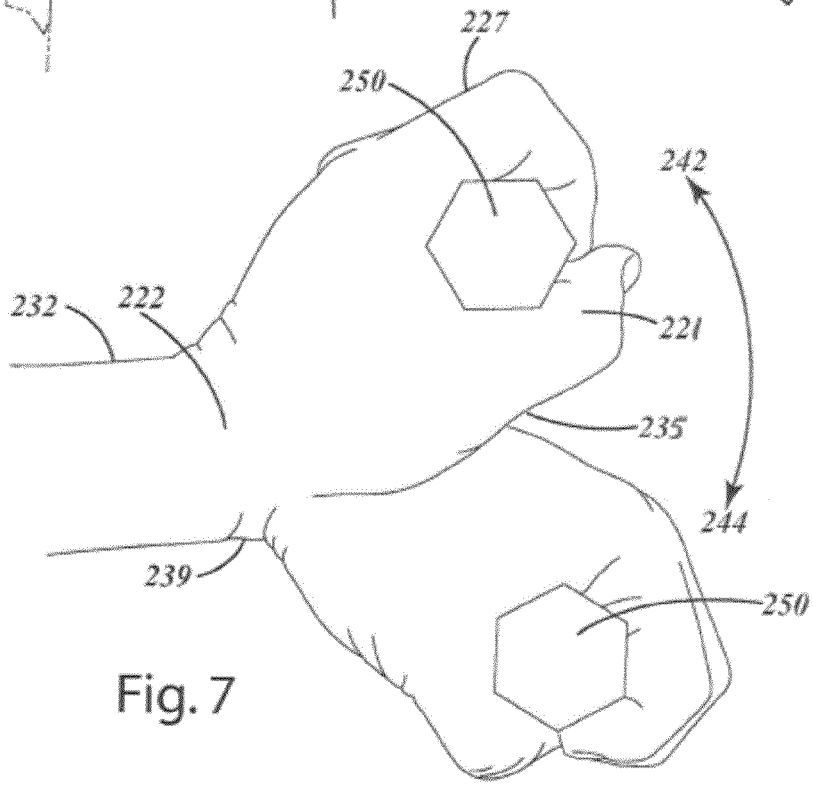
FIG. 7 is a side view illustration of movement of a wearer's hand.

The description of the glove 10 can be aided by a brief discussion of hand anatomy and movement. Several elements and movements of a wearer's anatomical hand that are promoted by the glove 10 are illustrated in FIGS. 6-7. In particular, a wearer's hand 220 generally includes a wrist 222, fingers 227 and a thumb 221. The hand further includes different "sides," in particular, a dorsal side 232, a palmar side 235, an ulnar side 223 and a radial side 233. The wrist 222 is movable in a variety of orientations, either by itself, or as it grasps an item, such as a game stick 250 as illustrated. FIG. 7 shows a wearer's hand with the wrist 222 in extension 242 and flexion 244 configurations. FIG. 6 shows a wearer's hand with the wrist 222 in an ulnar deviation 246 and in a radial deviation 248 configuration. The degree of the above configurations can vary, and the movements can occur in combination. For example, a wearer can move their hand so that it both extends and undergoes radial deviation. An infinite number of other combinations and degrees of wrist and hand movements are possible.

Returning to FIGS. 1-5, and utilizing the above element and movement references, the protective glove can include a back portion 12 and a palm portion 14, between which an interior space adapted to receive a wearer's hand is defined. The back portion 12 can be configured so that it generally is adjacent the dorsal side 232 (FIG. 7) of the hand, while the palmar portion 14 can be adjacent the palmar side 235 of the hand.

The glove 10 can further include a cuff portion 16, a hand portion 18 joined to the cuff portion 16, a plurality of finger portions 20 extending from the hand portion 18, and a thumb portion 22 extending from the hand portion 18. A floating sub-cuff portion 24 can be disposed under the cuff portion 16. A contoured wrist guard 26 can be positioned over a junction 95, optionally defines a gap 96 between the hand portion 18 and the cuff portion 16. The contoured wrist guard 26 can include a lowered back region 100 and a raised side region 102, and the side region 102 that is configured in close proximity to the opposing padded thumb portion 80.

Figure 2:
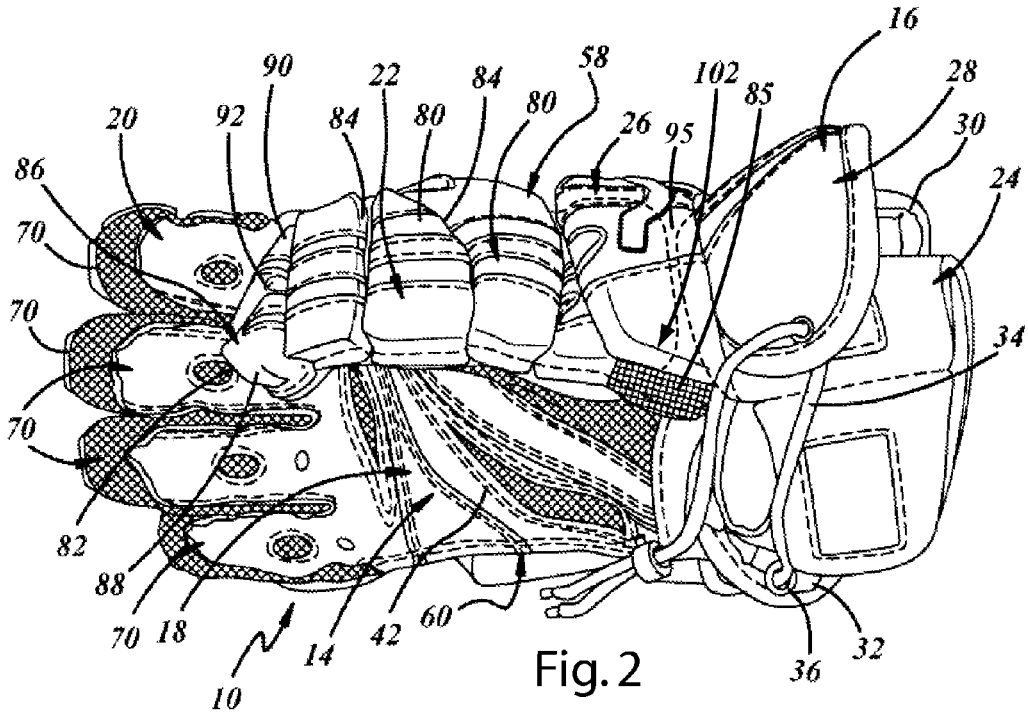
FIG. 2 is a bottom view of the glove.
Figure 3:
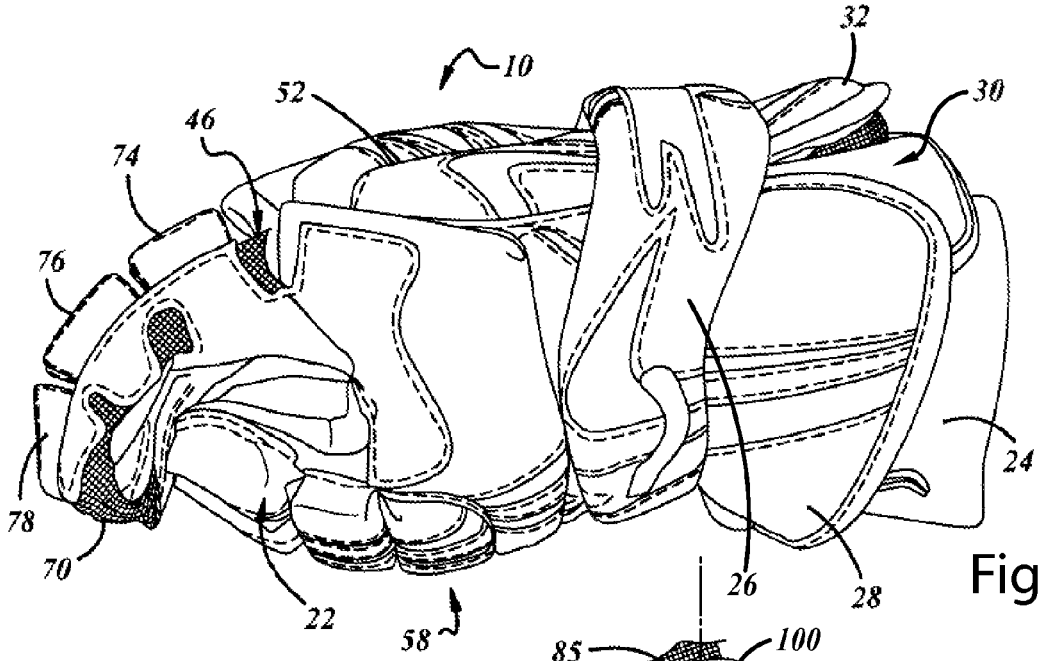
FIG. 3 is a first side view of the glove.

As shown in FIGS. 1-3, the hand portion 18 generally extends between the cuff portion 16 and the finger portions 20. The hand portion 18 can include a hand dorsal portion 40 and an opposing hand palmar portion 42. The hand dorsal portion 40 optionally can include multiple protective portions 44, such as padded portions, secured thereto to provide protection to a wearer's hand. The protective portions 44 can be constructed of foam, polyurethane, polymers or other suitable materials. As shown in FIG. 1, the hand dorsal portion 40 is optionally subdivided into multiple protective portions 44 that are sewn into a protective outer material such as a cloth material or the like. Each pair of protective portions 44 can define a respective flex line 46 there between, which allow the glove 10 to move as a wearer's hand moves to provide better fit and comfort during play. Optional flex lines are described in the following paragraphs. However, the flex lines can take on a variety of different configurations and placements as desired.

The protective portions 44 can terminate generally at a junction 47 located generally between the hand portion 18 and the finger portions 20. The junction 47 can allow the finger portions 20 to move with respect to the adjacent protective portions 44 as the junction 47 is generally disposed over a wearer's knuckle area, allowing the finger portions 20 to move as a wearer's fingers flex. Additionally, the hand dorsal portion 40 can include a vertical flex line 50 that can extend generally from the cuff portion 16 to the junction 47 and can allow protective portions 44 on either side thereof to move respect to one another. The vertical flex line 50 can also allow the glove 10 to fit more comfortably as it can allow the glove 10 to better conform to a wearer's hand as he closes his hand around a stick and, therefore, providing a tighter shape. This is desirable as the back of a typical wearer's hand is not flat and the protective portions 44 may not be flexible enough to bend without the vertical flex line 50.

The hand dorsal portion 40 can include a pair of opposing angled flex lines 52 and 54 which begin generally at the base of the hand portion 18 adjacent the cuff portion 16 and extend generally outward to the respective side 58, 60 of the hand portion 18. The angled flex lines 52, 54 can similarly assist the glove 10 in conforming to the wearer's hand as the protective portions 44 can each independently move with respect to the other protective portions 44 as a wearer's hand flexes during play, thus providing a better fitting glove. The hand dorsal portion 40 can have a variety of additional or different flex lines as desired.

The hand dorsal portion 40 can further include a plurality of vent openings 62, 64, 66 formed therein to provide ventilation to a wearer's hand. A vent opening 62 can be disposed along the vertical flex line 50. A vent opening 64 is optionally disposed along the first angled flex line 52. Another vent opening 66 can be disposed along the second angled flex line 54. The vent openings 62, 64, 66 can provide ventilation to a wearer's hand by allowing air into the glove interior. While three vent openings 62, 64, 66 are disclosed on the hand dorsal portion 40 of the glove 10, any number of vent openings can be utilized as desired. Additionally, the vent openings can be disposed in a variety of other locations along the protective portions 44 in accordance with the current embodiment, including within or through the respective individual protective portions themselves, instead of along the flex lines.

Referring to FIGS. 1-3, the cuff portion 16 can include a first cuff portion 28, an adjacent second cuff portion 30, and a third cuff portion 32 adjacent the second cuff portion 30. The first cuff portion 28 and the second cuff portion 30 and the third cuff portion 32 are secured at an upper border portion located near the hand portion 18. The first cuff portion 28, the second cuff portion 30 and the third cuff portion 32 each can define an edge that overlaps the opposing edge of the adjacent cuff portion to provide both flexibility and protection. Specifically, the overlapping edge portions of the cuff portions 28, 30, 32 yields a split cuff. The cuff portions 28, 30, 32 can be designed to cover and protect substantial portions of a wearer's wrist and forearm. The overlapping (split cuff) configuration of the cuff portions 28, 30, 32 can provide added protection to a wearer's wrist and forearm because of the double layer of padding, and because the cuff portions 28, 30, 32 can move with respect to one another they can provide increased flexibility for a wearer's wrist as the wrist moves during play. Optionally, a split cuff portion that does not include overlapping edges can also be employed. The cuff portion 16 can be secured to the hand portion 18 by an elastic sheet or strip (not shown) that allows the cuff portion 16 and the hand portion 18 to move and stretch with respect to one another. Optionally, instead of elastic, other stretchable materials, such as neoprene, can be utilized to connect the cuff portion 16 to the hand portion 18.

As shown in one embodiment, the first cuff portion 28 and the third cuff portion 32 may not extend entirely around the wearer's wrist and can be connected by a lace 34 that passes through openings 36 in each of the cuff portions. Optionally, the cuff portion 16 can consist of either a single or multiple pieces that extend entirely around a wearer's wrist. The cuff portion 16 can take on a variety of other suitable configurations as desired.

To the cuff portion 16, an optional floating subcuff portion 24 can be joined, and optionally substantially contained within the cuff portion 16. The subcuff portion 24 can be secured to the inner side of the first cuff portion 28 using an elastic member (not shown) and to the inner side of the third cuff portion 32 using another elastic member (not shown). The subcuff portion 24 can be attached to the cuff portion 16 in a variety of different ways, i.e., more or fewer elastic or inelastic straps, other compliant material or at a variety of different locations. Alternatively, the subcuff portion 24 can be flexibly attached to other portions of the glove 10. An optional subcuff portion 24 that can be used with the protective sports glove 10 is described in U.S. patent application Ser. No. 10/904,445, and entitled "Protective Sports Glove with Floating Cuff Portion," incorporated by reference herein.

Referring now to FIGS. 1-3, the one or more finger portions 20 can extend generally from the junction 47 to the respective tip 70 of each finger portion 20. The finger portions 20 can include one or more protective portions 74, 76, 78 that are sewn into a durable cover material as desired. The thumb portion 22 can also include a plurality of protective portions 80 that extend to the tip portion 82 of the thumb portion 22. Optionally, each protective portion 80 can be separated by a generally horizontal flex line 84. The protective portion 86 closest to the tip 82 is optionally sub-divided into a first part 88 and a second part 90 by a substantially vertical flex line 92. The number of protective portions and corresponding horizontal and vertical flex lines on the thumb portion 22 can take on a variety of different configurations as desired.

Referring to FIGS. 1-5, a contoured wrist guard 26 can be joined to the glove 10 such that it at least partially covers or conceals at least a portion of a junction 95 (FIGS. 1, 2). Where a gap 96 is defined at the junction 95 between the hand portion 18 and the cuff portion 16, the contoured wrist cuff 26 can cover or conceal that gap 96 as desired.

Figure 4:
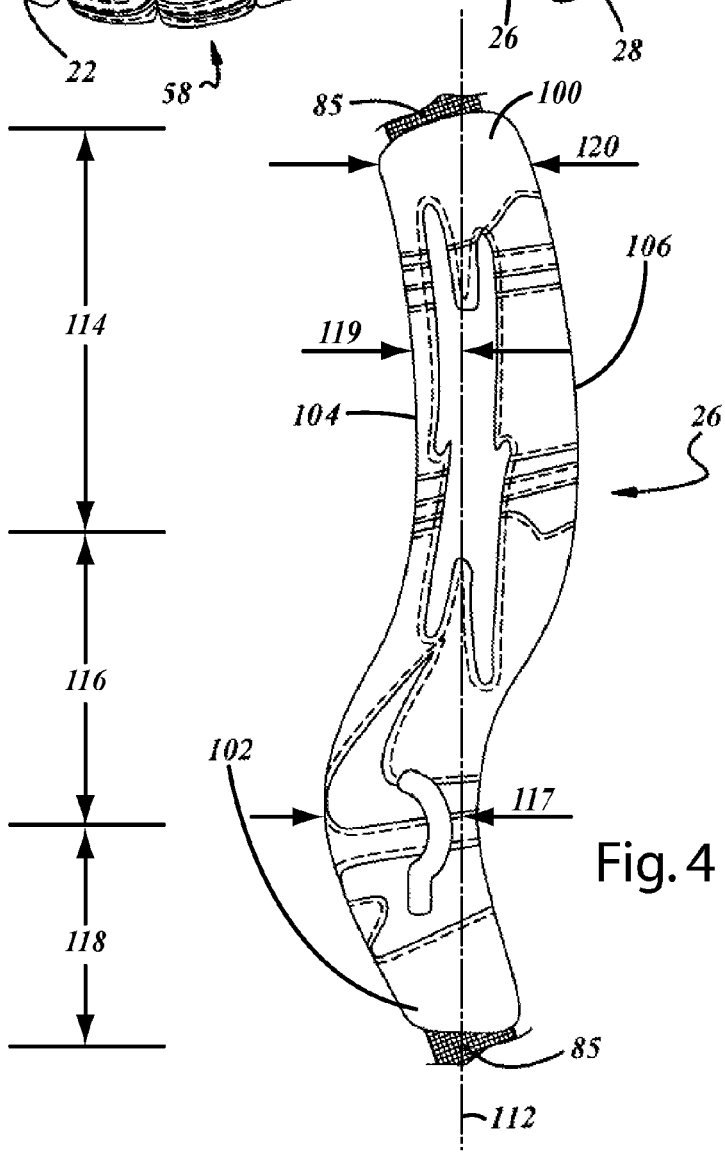
FIG. 4 is a top view of the contoured wrist guard, removed from the glove, in an extended configuration.

As shown in FIGS. 1,2 and 4, the contoured wrist cuff 26 can define a first end 100 adjacent the dorsal and/or ulnar sides of the hand portion 18 when the protective glove 10 is on the wearer. Optionally, the first end 100 can be located adjacent the palmar, ulnar and/or dorsal sides of the hand portion 18 and/or the glove 10 in general. The contoured wrist cuff can further define a second end 102 that is distal from the first end 100 and adjacent the palmar, radial, or dorsal portion of the wearer's hand when the protective glove 10 is on the wearer. Optionally, the second end 102 can be located adjacent the ulnar sides of the hand portion 18, and/or the glove 10.

The contoured wrist cuff 26 can be joined to the hand portion 18 and/or the cuff portion 16 and can be secured thereto by a variety of suitable means. For example, as shown in FIG. 4, the contoured wrist cuff 26 can include one or more attachment elements 85, which can join the contoured wrist cuff 26 to the glove 10, optionally the hand portion 14. The attachment elements 85 can be in the form of straps, bands, laces, pieces of material, or combinations of the same. The attachment elements 85 can be constructed from cloth, elastic or inelastic material, string, thread, plastic, rubber or any other suitable material. The attachment elements 85 can join the first end 100 and the second end 102 of the contoured wrist cuff 26 to the hand portion 18 or other portions of the glove 10 as desired.

As shown in FIG. 2, an attachment element 85 can be joined with a second end 102 of the contoured wrist cuff 26 to secure the contoured wrist cuff 26 to the hand portion 18 on a palmar side 42 of the hand portion. This attachment location can vary, with the first end 100 being joined with the hand portion on any one or more of the radial, ulnar, or dorsal sides of the glove 10. As shown in FIG. 1, the second end 102 of the contoured wrist cuff can be attached to the hand portion 18 adjacent a palmer side of the glove 40, and optionally the radial side of the glove.

As desired, this attachment location can vary, with the first end 100 joined with the dorsal, or ulnar side of the glove 10. Optionally, the first end 100 and second end 102 can be joined with one another so that the contoured wrist cuff 26 completely circumferentiates the wearer's hand, wrist and/or forearm as desired. Although shown connecting the contoured wrist cuff 26 to the hand portion 18, the attachment elements 85 can join the first end 100 or second end 102, or any other part of the contoured wrist cuff 26, to at least one of the cuff portion 16, the hand portion 18 and thumb portion 22, as desired. Moreover, additional attachment elements can be added to the contoured wrist cuff 26 intermediate the first end 100 and second end 102 to retain those intermediate regions in a generally fixed location. For example, an additional attachment element (not shown) can be added between the ends.

Figure 5:
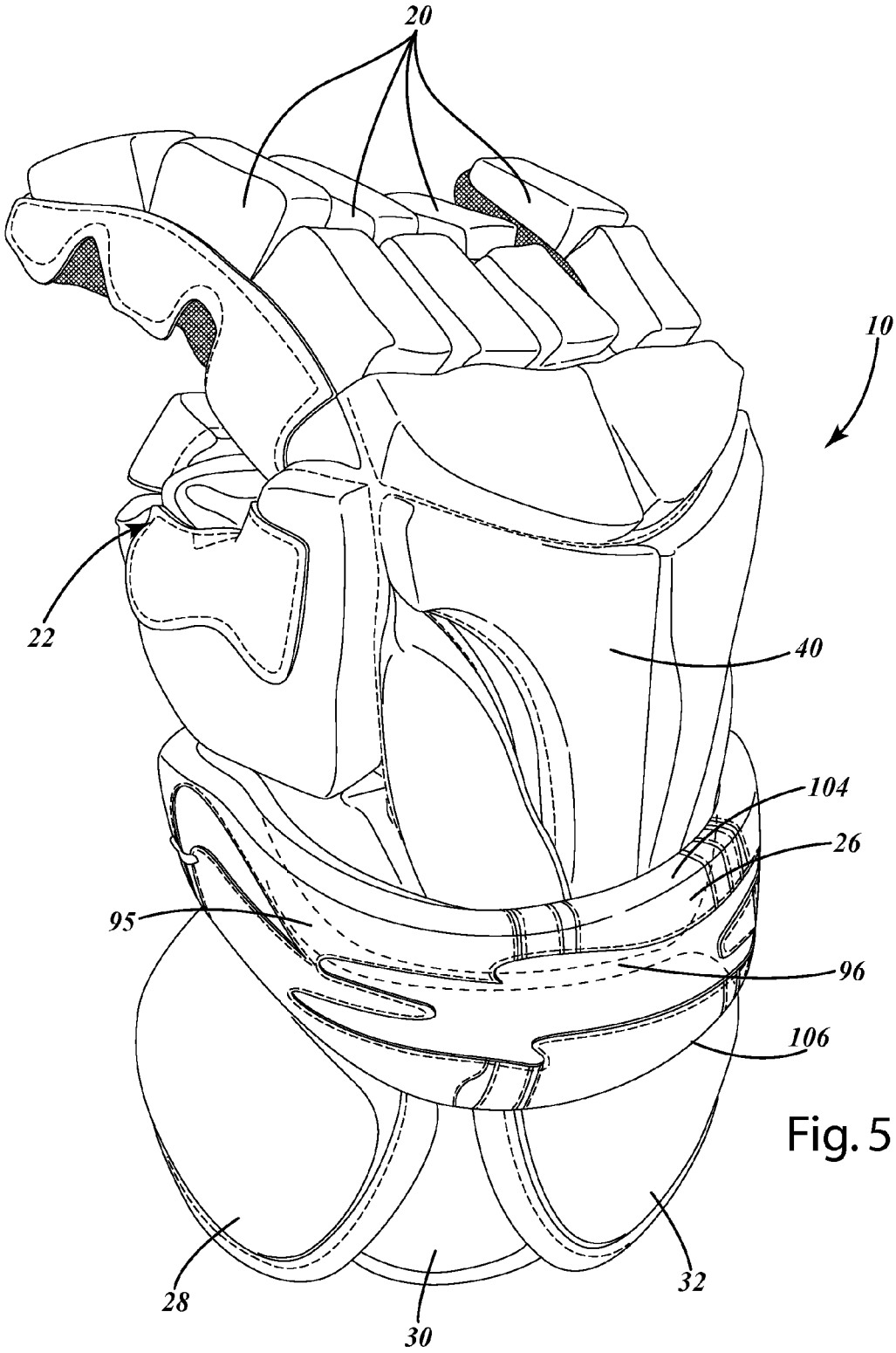
FIG. 5 is a top perspective view of the glove.

Returning to a general description of the contoured wrist cuff 26, with reference to FIGS. 4 and 5, the cuff 26 can include a leading edge 104 that is configured so that it will not substantially impair movement of the wrist as the wrist undergoes extension, radial deviation, or a combination of these and/or other wrist movements. The general configuration that enables this movement can be explained with reference to the way that the wrist cuff 26 extends across different sides of the hand portion 18 the glove 10, and/or the wearer's hand when the glove 10 is on the wearer's hand. The contoured wrist cuff leading edge 104 can generally be configured to face forwardly, toward the thumb and/or finger portions 20 of the glove 10. The leading edge 104 can be contoured rearwardly across a dorsal side of the glove 10. For example, the leading edge 104 can be rearwardly curved so that the curve opens towards the finger portions 20. Alternatively, leading edge 104 can be angled rearwardly across at least a portion of the dorsal side of the wearer's hand transitioning from the ulnar side of the hand to the radial side of the hand as the leading edge 104 of the contoured wrist cuff 26 extends across the dorsal side of the hand and transitions from the dorsal side to the radial side of the hand portion 18 and/or glove 10.

The leading edge 104 can optionally be contoured forwardly. For example, it can transition from a rearward curve to a forwardly opening to a curve that opens toward the finger portions 20, and then begins to curve away from the finger portions 20. Optionally, in this region, which can be adjacent the thumb portion, the leading edge 104 can generally extend forwardly toward the finger portions 20 and/or thumb portion 22. The leading edge 104, in the region adjacent at least a portion of the radial side of the wearer's hand, the glove 10 and/or the hand portion 18, can be contoured rearwardly. For example, after transitioning the foregoing portion of the glove 10, the leading edge 104 can curve or extend rearwardly across at least a portion of the radial side of the wearer's hand. The leading edge 104 can continue this rearward contour or extension to or into the palmar side of the wearer's hand, the glove 10 or the hand portion 18 as desired. The remainder of the contoured wrist cuff 26 adjacent rearward of the leading edge 104, can extend rearwardly a sufficient distance. With the contoured configuration of leading edge 104, and generally the wrist cuff 26, the contour can cover and/or conceal the junction 95 as mentioned without impairing radial deviation and extension of the wearer's wrist, or a combination of the foregoing, or other general movements of the hand such as flexion and ulnar deviation as shown in FIGS. 6 and 7.

As shown in FIG. 4, the contoured wrist cuff leading edge 104 can traverse the length of the contoured wrist cuff 26, generally from the first end 100 to the second end 102. The leading edge 104 can extend through multiple portions of the wrist cuff 26, for example, a first portion 114, a second portion 116, and a third portion 118, where all of these portions are included in the wrist cuff 26. The contour of the leading edge 104 can generally be described with reference to a longitudinal axis 112.

In general, the leading edge 104 in the first portion 114 of the wrist cuff 26 can extend or curve generally toward the longitudinal axis 112, as depicted in FIG. 4. Alternatively, the leading edge 104 in the first portion 114 can extend or curve away from the longitudinal axis 112, or it can remain generally aligned with the longitudinal axis 112. The leading edge 104 in the second portion 116 can extend or curve forwardly, away from the longitudinal axis 112. Optionally, in this portion, the leading edge can extend or curve toward the thumb portion 22 adjacent the radial side or palmar side of the wearer's hand when the glove is on the wearer or the hand portion 18 or the glove 10 in general, as depicted in FIGS. 3 and 4. In the third portion 118, the leading edge 104 can extend or curve rearwardly, toward the longitudinal axis 112, adjacent the radial side or palmar side of the wearer's hand when the glove is on the wearer or the hand portion 18 or the glove 10 in general, as depicted in FIGS. 2 and 4.

As also shown in FIGS. 4-5, the wrist cuff 26 can further define a trailing edge 106 distal from the leading edge 104 and traversing the length of the contoured wrist cuff 26. The trailing edge can extend from the first end 100 of the contoured wrist cuff 26 to the second end 102 of the contoured wrist cuff 26 through the first portion 114, second portion 116 and third portion 118 of the contoured wrist cuff 26. The trailing edge 106 in the first portion 114 can extend across the dorsal side of the cuff portion 16. In this first portion 114, the trailing edge can be at least one of generally aligned with the longitudinal axis 112, curving toward the longitudinal axis 112, and curving away from the longitudinal axis 112. The trailing edge 106 in the second portion 116 can extend forwardly, toward the longitudinal axis 112 and toward the thumb portion 22 adjacent at least one of the radial and palmar sides. The trailing edge 106 in the third portion 118 can extend rearwardly, away from the longitudinal axis 112, adjacent to at least one of the radial and palmar sides.

More generally speaking, the leading edge 104 alternatively can be defined in terms of its distance from the longitudinal axis 112 of the contoured wrist cuff 26. The leading edge 104 can be a first distance 119 from the longitudinal axis 112 of the contoured wrist cuff 26 in a region of the contoured wrist cuff 26 that extends across a dorsal side of the wearer's hand. As the contoured wrist cuff 26 extends around the wearer's wrist and/or hand, the leading edge 104 can vary in distance from the longitudinal axis 112. Near the thumb portion 22, the leading edge 104 can be a second distance 117 from the longitudinal axis 112. That second distance 117 can be greater than the first distance 119 such that the leading edge 104 near the thumb portion 22 projects forwardly to form a bulge adjacent the thumb portion 22 and/or over a radial side of the wearer's hand.

As shown in FIG. 4, the contoured wrist cuff 26 is configured in such a manner that it generally forms a reversed "s" shape as it transitions from the first end 100 to the second end 102 on a right hand glove. This "s" shape is slightly flattened from side to side or stretched longitudinally, depending on the point of view. Additionally, the contoured wrist cuff 26 can be configured in such a manner that it generally forms an "s" shape as it transitions from the first end 100 to the second end 102 on a left hand glove (not shown). Other alternative configurations of the contoured wrist cuff 26 can be selected as desired.

The contoured wrist cuff 26 can define a width 120 between the leading edge 104 and the trailing edge 106. In one embodiment, the width 120 can be substantially uniform and/or constant along the length of the contoured wrist cuff 26, and can generally follow the same contour as the leading edge 104, as shown in FIG. 4. In another embodiment, the trailing edge 106 can remain generally aligned with the longitudinal axis 112. The trailing edge 106, of course, can follow a variety of other contours as desired.

Although the figures of the present invention are described in connection with a contoured wrist cuff that is disposed exteriorly relative to the glove, and in particular the hand and cuff portions, the contoured wrist cuff 26 can be positioned within an interior of the glove 10 as desired. In such a configuration, the contoured wrist cuff 26 can be secured or otherwise joined with the interior of the hand portion 18 and/or the cuff portion 16 and extend in generally same fashion around the wearer's hand and/or wrist as the embodiments described above. In such an embodiment, the contoured wrist cuff 26 could still substantially conceal at least a portion of the junction 95 between the cuff portion 16 and the hand portion 18, however, the edges of those components, that is the hand portion 18 and the cuff portion 16, would still be exposed unless covered by another component.

The glove 10 and in particular, the contoured wrist cuff 26 of the present invention can provide protection of the wearer's wrist in flexion without impairing the radial deviation, ulnar deviation or extension of the wearer's wrist. The resulting increased flexibility potentially enhances the performance of a wearer. For example, the contoured wrist cuff 26 can enable a wearer to flex their wrist with a greater degree of freedom while passing or shooting a puck or ball with a stick used in these games. This can generate harder and more accurate shots and passes.

While the protective glove 10 of the present invention is directed to the sports of hockey and lacrosse, the protective glove 10 can also be utilized in a wide variety of sports, or occupational activities, in which protection to the hand or wrist is desired. Moreover, the particular contouring of the wrist cuff 26 of the present invention is not limited to the actual shape depicted, but can cover many similar variations that provide protection to the wrist and flexibility to the wrist in many directions.

Alternative Embodiment

Figure 8:
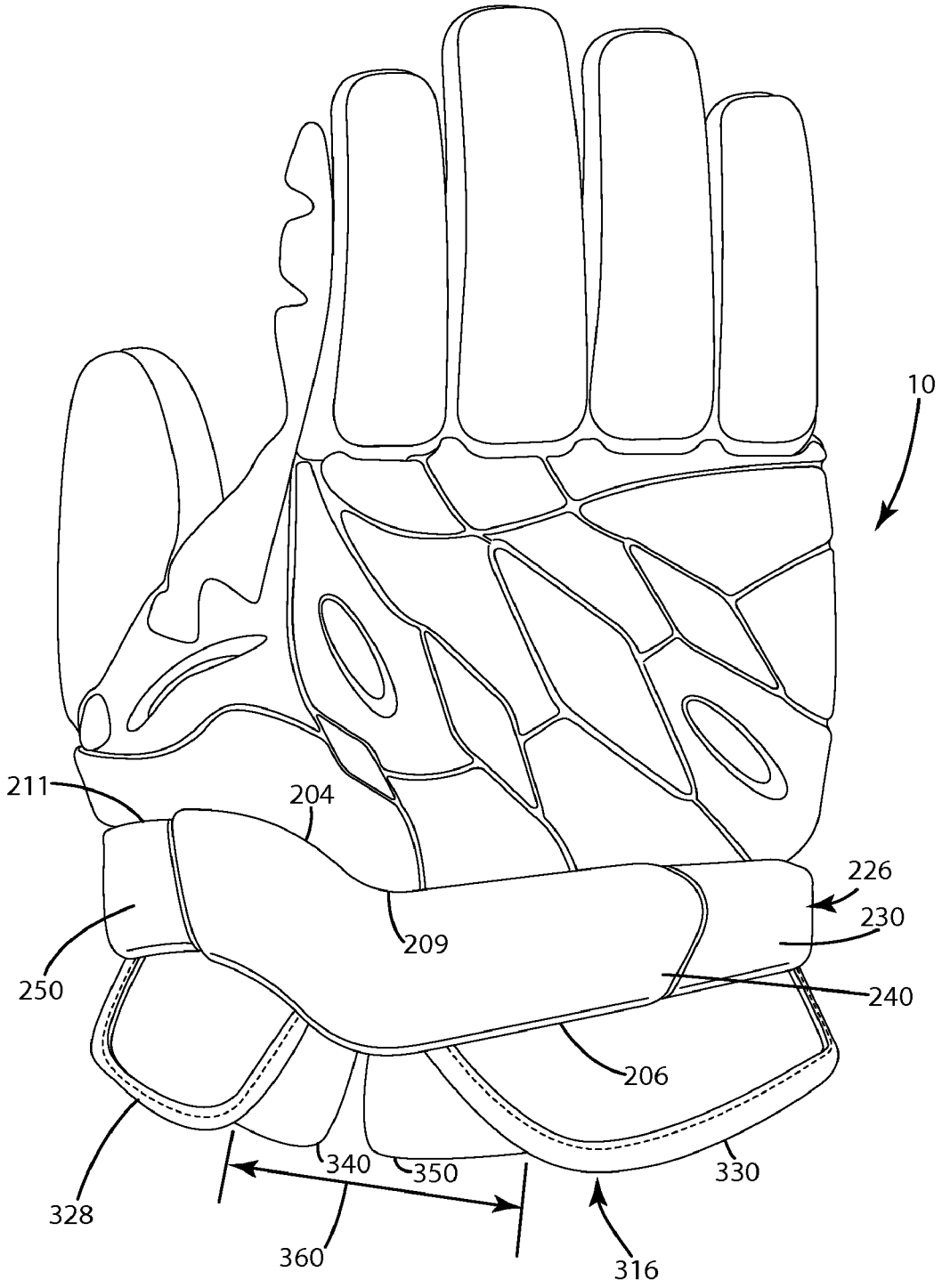
FIG. 8 is a top view of an alternative embodiment of the glove including a segmented contoured wrist guard and a segmented cuff.

An alternative embodiment of the glove shown in FIG. 8 can include a contoured wrist cuff 226 having multiple segments 230, 240 and 250 joined with and moveable relative to one another. In general, the adjacent segments of the contoured wrist guard can be joined to enable those segments to move relative to one another while the contoured wrist guard conceals the junction between the cuff and the hand portion of the glove. The contoured wrist guard can also be constructed so that it does not impair movement of the wearer's wrist when the wearer moves the wrist, for example, when holding or moving a game stick.

The alternative embodiment of the glove shown in FIG. 8 also can include a cuff portion 316 that includes a first cuff portion 328 and a second cuff portion 330, separated from one another by a gap 360. The cuff portion 316 can include cuff flaps 340 and 350 that are joined with the respective first cuff portion 328 and second cuff portion 330. These flaps can protect the user's wrist and/or arm underlying the gap 360, yet still provide enhanced mobility of the user's wrist and flexibility to the glove.

Figure 9:
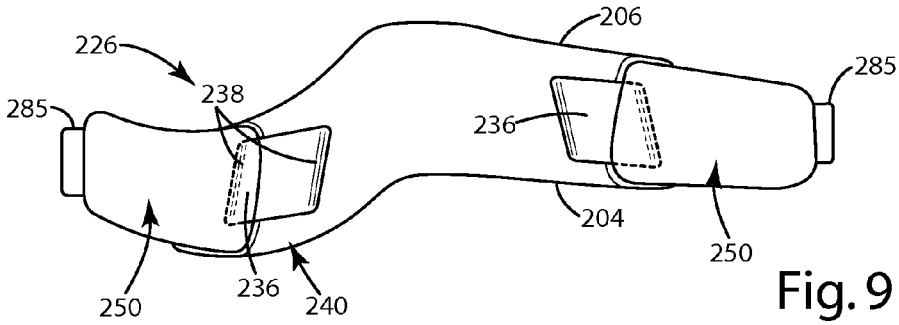
FIG. 9 is a view of the bottom of the segmented contoured wrist guard of the glove of the alternative embodiment.

As shown in FIG. 9, the contoured wrist cuff 226 includes a first segment 230, a second segment 240 and a third segment 250. Although shown as three distinct and separate segments, the contour wrist cuff 226 can be divided into two, three, four, five or more different segments as desired. The segments themselves are generally joined with one another via the elements 236, which can be flexible or inflexible, and which can be joined with respective adjacent ones of the segments via stitching, gluing, lacing or the like. Optionally, the flexible elements 236 can be a single continuous element (not shown) that extends across all of the segments, connecting them together, rather than individual pieces of flexible elements as illustrated in FIG. 9. Each of the individual segments 230, 240 and 250 can include an outer covering 227 constructed from leather, plastic, composite, elastic or other materials. The outer cover 227 can generally cover a padding material 258, disposed on the interior of the segment. The padding 258 can be rigid, semi-rigid or of a cushion construction that dissipates the force of impact provided by a blow to the respective segment with an item, such as a game stick. Optionally, each segment can be constructed from a solid piece of material that does not have an exterior covering as desired.

The flexible elements or member 236 are generally a piece of material, fabric, plastic, or other component that is adapted to enable adjacent segments of the contoured wrist guard to move relative to one another when a wearer of the glove moves their wrist. In some cases, the flexible member can enable the adjacent segments to articulate, as well as optionally extend, and/or retract relative to one another. Further optionally, the flexible member can be constructed from an elastic material, in which case the flexible member is referred to as an elastic member. As used herein, an elastic member is capable of resuming its original shape and dimensions after stretching or compressing or being extended. For example, an elastic member can be stretched by one segment moving away from another segment. The elastic member will retract on its own to pull the segment back to its previous configuration relative to the other segment. A non-limiting example of an elastic member is a flexible, stretchable fabric made with interwoven strands of rubber or a stretchable polymeric material or an imitative synthetic fiber. Of course, an elastic member can also include a simple sheet of durable rubber or a composite or a synthetic material that can be stretched or extended and then retracted to its original shape and/or dimensions.

Returning to FIGS. 8-10, the leading edge portion 204, as well as the trailing edge 206, can be divided among the first segment 230, second segment 240 and third segment 250. For example, edge portion 204 corresponding to the first segment 230 can extend generally straight across the portion of the dorsal side of at least one of the wearer's hand and/or glove when the glove is on the wearer's hand. The leading edge portion 204 corresponding to the second segment 240 can be contoured rearwardly across another portion of the dorsal side of at least one of the wearer's hand and/or wrist. Optionally, the leading edge portion 204 on the second segment 240 can include compound contours. For example, although the leading edge 204 extends generally straight across a portion of the dorsal side of the hand, on the second segment 240, as the leading edge 204 approaches the thumb portion, it can generally form a curve 209 that opens forwardly on the second segment as illustrated in FIG. 8. In this manner, the second segment, as it nears the thumb portion transitions to a forward contour.

The leading edge 204 corresponding to the third segment 250 can be contoured rearwardly adjacent the thumb portion, generally being a curve 211 opening rearwardly, or away from the thumb portion. Of course, other contours can be included in the leading edge 204 as desired. Moreover, the segments can include different portions of the leading edge portion 204 and its respective contours as desired.

Figure 10:
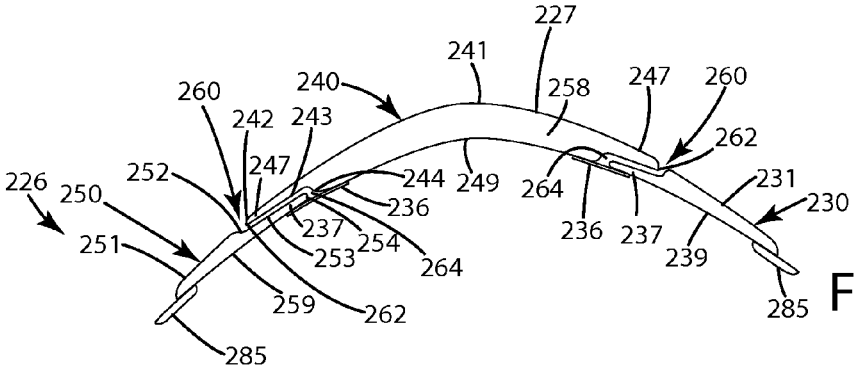
FIG. 10 is a cross section of the segmented contoured wrist guard of the glove of the alternative embodiment in an un-extended mode.
Figure 11:
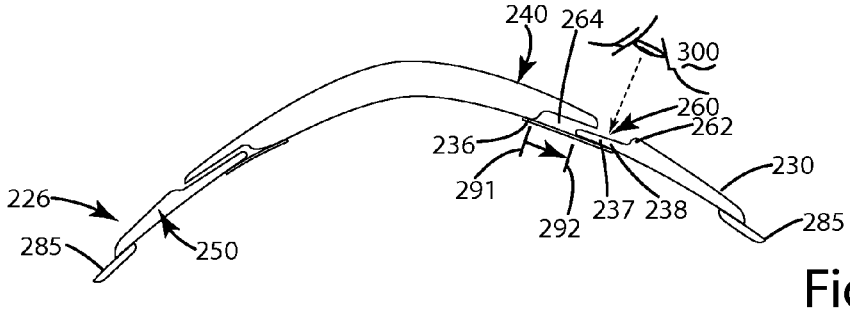
FIG. 11 is a cross section of the segmented contoured wrist guard of the glove of the alternative embodiment in an extended mode.

The segments 230, 240 and 250 of the contoured wrist cuff 226 can be joined together in a variety of manners. For example, the segments can include overhang contours and step contours that generally nest with one another with a gap formed therebetween. As shown in FIGS. 10 and 11, the first segment 230 can include a first step contour 237 that is immediately adjacent an overhang contour 247 of the second segment 240. Between the step contour 237 and overhang contour 247, a gap 260 is defined. The gap 260 is at least partially closed by the flexible member 236 spanning a portion of the gap on the rear surfaces 239 and 249 of the respective first and second segments.

The flexible member 236 can span, as shown in FIGS. 9 and 10 across a portion of the gap generally from a region inward from the leading edge 204 to a region inward of the trailing edge 206. As desired, the flexible member 236 can span from the leading edge all the way to the trailing edge 206.

Referring again to FIG. 10, gap 260 between the segments can have a variety of configurations. For example, the gap 260 between the first 230 and second 240 segments can include a first part 262 and a second part 264. Generally, the second part 264 is concealed from view when the glove 10 is on the wearer's hand. In one example, the second part 264 can be offset from the first part 262 of the gap. In this construction, with the offset portions of the gap 260, a viewer viewing the first part 262 of the gap 260 cannot see the flexible member 236 at the other part of the gap 264.

Optionally, the gap 260 can be configured so that when the contour cuff segments 230 and 240 are stretched from an unextended mode 291 to an extended mode or stretched mode 292 (FIG. 11), the second part 264 of the gap still remains concealed from view from a viewer 300. Likewise, the end 238 of the first segment 230, as well as the flexible member 236, can also remain concealed from the view of the viewer 300 even when the first segment 250 is stretched or expanded relative to the second segment 240.

As shown in FIG. 10, the gap 260 generally begins at the front surfaces 231, 241 of the respective first and second segments and extends in a tortuous or zigzag manner from those front surfaces to the rear surfaces 239 and 249 of the first and second segments. Between the first part 262 and the second part 264, the gap 260 can extend generally transversely between portions of the first segment 230 and second segment 240, from the first part of the gap 262 to the second part of the gap 264. In so doing, this transverse portion, or third portion of the gap can be generally parallel to the front surfaces and/or rear surfaces of the respective first and second segments 230, 240.

Optionally, instead of having a tortuous or a zigzag configuration, the gap 260 can be angled (not shown) from the first part 262 to the second part 264. The overhang contour 247 in such a configuration can simply be an outwardly angled portion of the second segment 240, which extends over an inwardly angled step 237 of the first portion 230. Further optionally, the gap can be curved (not shown) or of other configurations as desired.

In general, the overhang contour 247 can overlap the step contour 237. The overhang contour 247 can also conceal at least a portion of the gap 260 defined between the first segment 230 and the second segment 240. More specifically, the overhang contour 247 can include a first portion 244 that extends from the rear surface 249 of the segment 240 toward the front surface 241. In this region, the first portion can extend at an angle, and/or in a curved manner from the rear surface 249. The overhang contour 247 also can include a second portion 242 that extends from the front surface 241 in a curved, angled and/or straight manner toward the rear surface 249. The second portion 242 can extend in a curved, angled and/or straight manner from the front surface toward the rear surface.

Between the first portion 244 and the second portion 242 of the overhang contour, the overhang contour can include an overhang third portion 243 that joins the first portion 244 and second portion 242. This third portion 243 can generally be parallel to at least one of the front surfaces 241 and 251 and/or the rear surfaces 249 and 259. Alternatively, the third portion 243 can be parallel to, offset at an angle, and/or curved relative to each or both of the aforementioned front and rear surfaces, depending on the application. Optionally, there may be multiple additional portions between the first portion and second portion at varying angles and/or having varying contours as desired.

The step contour 257 of the third segment 250, as well as the step contour 237 of the first segment 230 (if included), can include a variety of structures and portions that generally face and oppose the aforementioned portions of the overhang contour 247. For example, the step contour 257 can include a step first portion 254 that extends from the rear surface 259 toward the front surface 251. This first portion can extend in a curved, angled and/or straight manner as desired. The step contour 257 also can include a second portion 252 that extends from the front surface 251 toward the rear surface 259. This portion can be curved, angled and/or straight as well. Between these first and second portions, a third portion 253 can extend and join the respective step first portion and step second portion. The step third portion can be configured similar to the overhang third portion 247 as explained above. In general, the step third portion 253 and overhang third portion 243 can extend generally parallel to one another.

In operation, the contour wrist cuff segments can extend, retract and/or articulate relative to one another as a user moves their hand and/or wrist. As shown in FIG. 11, the segments 230 and 240 can articulate and/or extend and retract from configurations 291 to 292. As explained above, given the nesting of the contour overhang 247 and the step contour 237, the flexible member 236 can remain concealed from the vision of a viewer 300 even when the segments are stretched to the fully extended mode, as shown in FIG. 11. Of course, if this concealed configuration is not desired, the step and contour configurations can be eliminated or absent altogether from the contour wrist cuff 226.

Figure 12:
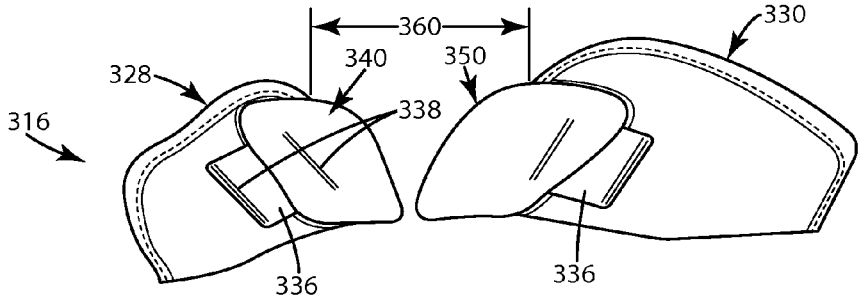
FIG. 12 is a view of the bottom of the segmented wrist cuff of the glove of the alternative embodiment.
Figure 13:
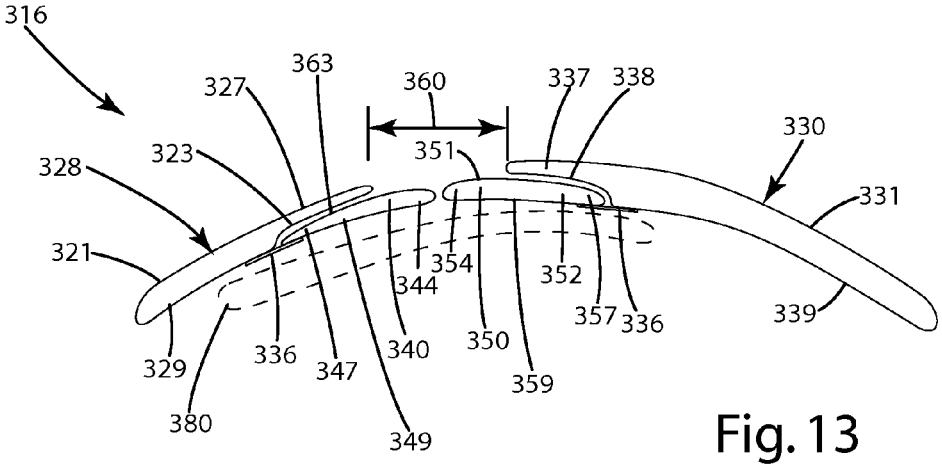
FIG. 13 is a cross section of the segmented wrist cuff of the glove of the alternative embodiment in an un-extended mode.

As shown in FIGS. 8 and 12-13, the cuff portion 316 of the alternative embodiment can provide improved mobility and movement of the wrist. As shown in FIG. 12, the cuff portion 316 generally includes a first cuff portion 328 and a second cuff portion 330 separated from one another by a gap 360. As compared to FIG. 3, the gap 360 is filled in with a third cuff portion 30. In the alternative embodiment of FIG. 12, however, the third cuff portion is deleted and replaced with cuff flaps 340 and 350. These cuff flaps are joined with the respective first and second cuff portions via the members 336, which can be of the same or similar construction as the flexible members 236 described above in connection with the contour wrist cuff 226.

The first cuff flap 340 and second cuff flap 350 extend toward one another to close at least a portion of the gap 360 so that a wearer's wrist under the gap is protected from blows by objects such as game sticks. As shown in FIG. 13, the first cuff 328 can include a front surface 327 and a rear surface 329 opposite the front surface, generally adjacent a wearer's wrist. The first cuff portion 328 also can include a first end 327, which is adjacent the gap 360 between the respective first cuff portion 328 and second cuff portion 330, and which is adjacent the intermediate gap 363 between the first cuff portion 328 and the first cuff flap 340. The first cuff portion 328 can include a front surface 321 and a rear surface 329. The flexible member 336 can be joined with the rear surface 329 of the first cuff portion 328 and the rear surface 349 of the cuff flap 340 to join the first cuff portion 328 and the cuff flap 340. The flexible member can be joined with the surfaces via stitching, gluing, melting and the like.

The first end 327 of the first cuff portion 328 extends outwardly over a first portion 347 of the first cuff flap 340 to conceal that first portion 347 of the first cuff flap 340. For example, the first end 327 of the first cuff portion 328 can define an overhang contour 323 that extends outwardly over at least a first portion 347 of the first cuff flap 340. In effect, the first overhang contour 323 can conceal from view the first end or portion 347 of the first cuff flap. An opposing end 344 of the first cuff flap 340 can remain exposed to view within the gap 360.

As shown in FIG. 13, the second cuff portion 330 can also include front 331 and rear 339 surfaces, as well as a first end 337 at which an overhang contour 338 extends. The overhang contour 338 can extend outwardly over at least a portion or end 357 of the second cuff flap 350. The second end 354 of the cuff flap 350 can remain exposed within the gap 360 so that the front surface 351 of the second end 354 remains visible through the gap 360.

The ends 344 and 354 of the respective cuff flaps 340 and 350 can project into the gap 360 and can be disposed adjacent one another to effectively close off a substantial portion of the gap 360 so that the user's wrist thereunder is protected from blows. If desired, an optional third cuff portion 380 can be joined with the glove and can extend under the first cuff flap 340 and/or the second cuff flap 350.

Figure 14:
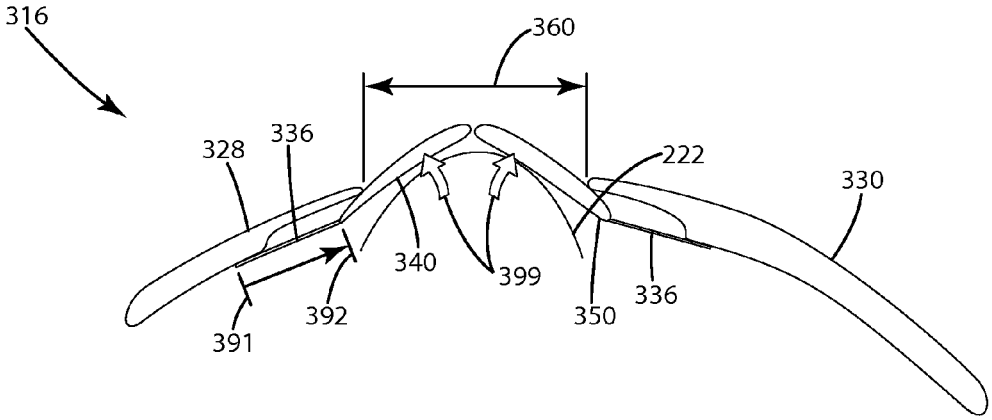
FIG. 14 is a cross section of the segmented wrist cuff of the glove of the alternative embodiment in an extended mode.

In operation, the cuff flaps 340 and 350 can move relative to one another and relative to the cuff portions 328 and 330 to which they are joined with the respective flexible members 336. As shown in FIG. 14, the cuff flaps 340 and 350 optionally can extend and move from original position 391 to second position 392, generally from an unextended mode to an extended mode. In so doing, the flexible cuff flaps 340 and 350 can also articulate and/or rotate in the direction of the arrows 399. This type of movement can be caused by a user's wrist 322 moving in direction 248 (FIG. 6), undergoing radial deviation. When undergoing such movement, the wrist 222, in effect, presses against the cuff flaps 340 and 350, moving them in the direction of the arrows 399 in FIG. 14. Because the cuff flaps 340 and 350 are joined to the cuff portions 328, 330, respectively via, the members 336, the flaps move to provide a greater range of generally uninhibited motion while still protecting the wrist 222 from blows by a stick or other objects. Optionally, although shown as extending from an unextended mode to an extended mode, where the cuff flaps are joined with the cuff portions via a flexible member that is not elastic or is inflexible, the cuff flaps can simply rotate or move, without extending away from or relative to the cuff portions.

The above description is that of the current embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A protective sports glove, comprising:

a hand portion including a hand palmar portion and an opposing hand dorsal portion;

a finger portion joined with and extending from the hand portion;

a thumb portion joined with and extending from the hand portion;

a cuff portion joined with the hand portion at a junction; and a contoured wrist cuff including a leading edge generally facing the finger and thumb portions, and a trailing edge rearwardly distal from the leading edge, the contoured wrist cuff including a first segment joined with a second segment, the first segment including a first step contour, the second segment including an first overhang contour, the first overhang contour overlapped over the first step contour, the first overhang contour concealing at least a portion of a gap defined between the first segment and the second segment, the first segment and the second segment being joined with a first elastic element, wherein the first segment and second segment flexibly move relative to one another when a wearer of the glove moves their wrist, wherein the contoured wrist cuff is positioned adjacent the cuff portion and the hand portion so that the contoured cuff substantially conceals the junction between the cuff and the hand portion without impairing at least one of radial deviation and extension of the wearer's wrist.

2. The protective sports glove of claim 1 wherein the first segment includes a first segment bottom surface, wherein the second segment includes a second segment bottom surface, wherein the first elastic element is joined with the first segment bottom surface and the second segment bottom surface, and spans the gap defined between the first segment and the second segment.

3. The protective sports glove of claim 1 comprising a third segment, joined with the second segment via a second elastic element.

4. The protective sports glove of claim 3 wherein the second segment includes a second overhang contour, wherein the third segment includes a second step contour, wherein the second overhang contour overlaps the second step contour, wherein the second overhang contour conceals at least a portion of a gap defined between the third segment and the second segment.

5. The protective sports glove of claim 3 wherein the leading edge is divided into portions corresponding to the first, second and third segments, wherein the leading edge portion corresponding to the first segment extends generally straight across a portion of the dorsal side of at least one of a wearer's hand and wrist when the glove is on a wearer's hand, wherein the leading edge portion corresponding to the second segment is contoured rearwardly across another portion of the dorsal side of at least one of a wearer's hand and wrist when the glove is on a wearer's hand and is contoured forwardly adjacent the thumb portion, wherein the leading edge portion corresponding to the third segment is contoured rearwardly adjacent the thumb.

6. The protective sports glove of claim 1 wherein the second segment includes a leading edge portion and a trailing edge portion, wherein the trailing edge portion of the second segment is contoured rearwardly across the dorsal side of at least one of a wearer's hand and wrist when the glove is on a wearer's hand, wherein the trailing edge portion of the second segment is contoured forwardly adjacent the thumb portion.

7. The protective sports glove of claim 1 wherein the first elastic member spans at least a portion of the gap between the first segment and the second segment.

8. The protective sports glove of claim 7 wherein the first overhang contour includes an end and is of a sufficient length so that when the first elastic member is stretched to its fully extended mode, at least the end still conceals the first elastic member spanning the at least a portion of the gap between the first segment and the second segment.

9. The protective sports glove of claim 1 wherein the leading edge generally forms at least one of an "S" shape and a reversed "S" shape as the leading edge transitions from a first end to a second end of the contoured cuff.

10. The protective sports glove of claim 9 wherein the first segment includes an end, wherein the second segment includes a first overhang contour overlapped over the end, the first overhang contour concealing at least a portion of a gap defined between the first segment and the second segment, as well as at least a portion of the end, wherein the flexible element is an elastic element.

11. A protective sports glove, comprising:

a hand portion including a palmar portion adapted to be positioned on a palmar side of a wearer's hand and an opposing dorsal portion adapted to be positioned on a dorsal side of the wearer's hand, the dorsal portion including a plurality of hand padding elements;

a finger portion joined with and extending from the hand portion, the finger portion adapted to receive a finger of a wearer, the finger portion including a finger padding element to protect a dorsal side of the finger of the wearer;

a thumb portion joined with and extending from the hand portion, the thumb portion adapted to receive a wearer's thumb extending from a radial side of the wearer's hand, the radial side of the wearer's hand being opposite an ulnar side of the wearer's hand, the thumb portion including a thumb padding element to protect a dorsal side of the thumb of the wearer;

a cuff portion joined with the hand portion at a junction, the cuff portion adapted to cover at least a portion of at least one of a wrist and a forearm of the wearer; and a contoured wrist cuff joined with at least one of the hand portion, the thumb portion and the cuff, the contoured wrist cuff including a plurality of segments, adjacent ones of the segments joined with a flexible member, each segment including an outer covering and an internal padding, each segment separated from one another by a gap, the gap including a first part and a second part, the first part of the gap being visible when the glove is on the wearer's hand, the second part being concealed from view when the glove is on the wearer's hand, the second part being offset from the first part of the gap, wherein the plurality of segments flexibly move relative to one another, the flexible member at least one of articulating, extending and retracting, when a wearer of the glove moves their wrist, wherein the contoured wrist cuff substantially conceals at least a portion of the junction between the cuff and the hand portion without impairing at least one of radial deviation and extension of the wearer's wrist when the wearer manipulates a game stick.

12. The protective sports glove of claim 11 wherein the elastic member joins adjacent ones of the segments near the second part of the gap.

13. The protective sports glove of claim 11 wherein the contoured wrist cuff includes a first end and a second end, wherein the contoured wrist cuff defines a trailing edge extending from the first end of the contoured wrist cuff to the second end of the contoured wrist cuff, across the plurality of segments, the trailing edge being contoured rearward in at least one of the plurality of segments, the trailing edge being substantially linear in another of at least one of the plurality of segments.

14. The protective sports glove of claim 11 wherein a first segment of the plurality of segments includes a first front surface, a first rear surface, and an overhang contour, the overhang contour including an overhang first portion that extends from the first rear surface toward the first front surface, an overhang second portion that extends from the first front surface toward the first rear surface, and an overhang third portion that joins the overhang first portion and the overhang second portion.

15. The protective sports glove of claim 14 wherein the overhang third portion extends generally parallel to at least one of the first front surface and the first rear surface.

16. The protective sports glove of claim 14 wherein a second segment of the plurality of segments includes a second front surface, a second rear surface, and a step contour, the step contour including a step first portion that extends from the second rear surface toward the second front surface, a step second portion that extends from the second front surface toward the second rear surface, and a step third portion that connects the step first portion and the step second portion.

17. The protective glove of claim 16 wherein the step third portion extends generally parallel to at least one of the second front surface and the second rear surface.

18. The protective glove of claim 16 wherein the overhang third portion and the step third portion face one another and are generally parallel to one another, wherein the overhang third portion conceals at least a portion of the step third portion.

19. The protective glove of claim 16 wherein the step first portion is adjacent the overhang first portion near the first part of the gap, wherein the step second portion is adjacent the overhang second portion adjacent the second part of the gap.

20. The protective glove of claim 16 wherein the plurality of segments include a front surface and a rear surface, wherein the first part of the gap opens adjacent the front surface, wherein the second part of the gap opens adjacent the rear surface, wherein the gap extends transversely between portions of adjacent ones of the plurality of segments from the first part of the gap to the second part of the gap.

21. A protective sports glove, comprising:

a hand portion including a hand palmar portion and an opposing hand dorsal portion;

a finger portion joined with and extending from the hand portion;

a thumb portion joined with and extending from the hand portion;

a cuff portion joined with the hand portion at a junction; and a contoured wrist cuff including a leading edge generally facing the finger and thumb portions, the contoured wrist cuff including a first segment and a second segment joined with one another by a flexible element that enables the first segment and second segment to at least one of articulate, extend and retract relative to one another, wherein the contoured wrist cuff is positioned adjacent the cuff portion and the hand portion so that the contoured wrist cuff substantially conceals the at least a portion of the junction between the cuff and the hand portion without impairing at least one of radial deviation and extension of the wearer's wrist.

22. The protective sports glove of claim 21 wherein the leading edge generally forms at least one of an "S" shape and a reversed "S" shape as the leading edge transitions from a first end to a second end of the contoured wrist cuff.

23. A protective sports glove, comprising:

a hand portion including a hand palmar portion and an opposing hand dorsal portion;

a finger portion joined with and extending from the hand portion;

a thumb portion joined with and extending from the hand portion; and a cuff portion joined with the hand portion at a junction, wherein the cuff portion includes a first cuff portion and a second cuff portion, separated from one another by a gap, the first cuff portion including a first cuff flap joined with the first cuff portion via a first flexible member, the second cuff portion including a second cuff flap joined with the second cuff portion via a second flexible member, wherein the first cuff flap and second cuff flap extend toward one another in the gap to close at least a portion of the gap so that a wearer's wrist under the gap is protected from blows, wherein the first cuff portion includes a first end adjacent the gap, wherein the first end includes an overhang contour, wherein the overhang contour extends outwardly over a first portion of the first cuff flap.

* * * * *